US005902637A

United States Patent [19]

Castellano, Jr. et al.

[11] Patent Number: 5,902,637

[45] Date of Patent: May 11, 1999

[54] WATER REPELLENT RESTORATIVE AND PROCESS OF USE

[75] Inventors: Eugene N. Castellano, Jr., Wilmington, Del.; Debra Lynne Raup, Havre de Grace, Md.

[73] Assignee: W. L. Gore & Associates, Inc., Newark, Del.

[21] Appl. No.: 08/967,531

[22] Filed: Nov. 10, 1997

[51] Int. Cl.[6] ..... B05D 3/12

[52] U.S. Cl. ..... 427/242; 239/86; 427/393.4; 427/421

[58] Field of Search ..... 427/393.4, 242, 427/421; 239/86

[56] References Cited

U.S. PATENT DOCUMENTS

| | | | |
|---|---|---|---|
| 3,869,465 | 3/1975 | Waldmann | 427/393.4 X |
| 5,169,891 | 12/1992 | Brown | 524/284 |
| 5,370,919 | 12/1994 | Ficaws et al. | 428/96 |
| 5,725,789 | 3/1998 | Habu et al. | 427/393.4 X |

OTHER PUBLICATIONS

Product Label—Kenyon's Water–Based Fabric Protector, No date.

Product Label—Tectron Outdoor Fabric Protector, No date.

Product Label—Nikwax TX.Direct Spray On, no date.

Product Label—Nikwax TX.Direct Wash In, no date.

Product Label—Tectron Protects & Repels, no date.

Product Label—Tectron Washin–In Waterproof, no date.

Product Label—Du Pont Zepel Rain/Stain Repeller, no date.

Product Label—3M Scotchgard Brand Outdoor Fabric Water Repellent, no date.

*Primary Examiner*—Michael Lusignan

*Attorney, Agent, or Firm*—Gary A. Samuels

[57] ABSTRACT

An application method restores the water or stain repellency of outer wear, foot wear, apparel, clothing, shelters, or fabrics that have already been pretreated with a water or stain repellent finish. This method involves washing the apparel item or fabric, rinsing it, removing excess rinse water and then applying the restorative repellent treatment to the wet apparel item or fabric by spray. The retreated apparel item or fabric is then dried and heated for a sufficient time to cause distribution of the new repellent material with residual amounts of the original repellent finish and activation of the fluoropolymer.

11 Claims, 1 Drawing Sheet

WATER REPELLENT RESTORATIVE AND PROCESS OF USE

FIELD OF THE INVENTION

This invention relates to restoring water and stain repellency to used water repellent fabrics, apparel, and the like. More particularly, this invention relates to restoring such repellency to used water repellent fabrics and apparel which contain integral water impermeable, water-vapor permeable material.

DESCRIPTION OF RELATED ART

It is well known to treat new fabrics and apparel to provide water and stain repellency. In particular, new carpets, shelters, e.g., tents, and outer wear such as jackets, rain coats, boots and the like, are treated during manufacture with coating compositions which provide water repellency and stain resistance. Such coating compositions include blends of ethylene vinyl acetate polymers with fatty acid emulsions as disclosed in U.S. Pat. No. 5,169,891; and fluorochemical compositions containing fluoroaliphatic radical containing polyoxyalkylene compounds as disclosed in U.S. Pat. No. 5,370,919. In addition to conventional outer wear, outer wear containing an integral water-impermeable, water vapor permeable membrane is likewise treated at manufacture with a water repellent coating composition to prevent outer fabrics from being soaked with water and/or stained.

It is also well known, that after a period of use and laundering, treated fabrics and apparel may partially or completely lose their water and stain repellency. Several methods are available to restore water and stain repellency to conventional fabrics and apparel. In one method, the used garment is first laundered and dried, and the clean dry garment is then sprayed with a water repellent composition and allowed to air dry or tumble dry at low heat. In another method the garment is first pre washed, and then the washing cycle is repeated except that the water repellent is added in place of the detergent. After the cycle is complete, the garment typically is tumble dried at low heat.

While current methods have been somewhat successful in restoring water and stain repellency to used garments with residual repellency, there continues to be an industry need to efficiently restore water and stain repellency to such used garments which contain an integral water-impermeable, water vapor permeable membrane.

SUMMARY OF THE INVENTION

This need is met by the repellency restoration method of this invention which is a method for restoring water or stain repellency to a pretreated fabric or apparel having an integral water impermeable, water-vapor permeable material, wherein said pretreated fabric or apparel had been pretreated with a water or stain repellent finish; the method comprising:

A. laundering and rinsing the pretreated fabric or apparel to provide a wet, clean fabric or apparel;

B. spraying an outer surface of the wet, clean fabric or apparel with a restorative liquid consisting of:
   (a) a fluoroacrylate copolymer emulsion,
   (b) a liquid coalescing agent, and
   (c) a preponderance of water, to provide a wet, retreated fabric or apparel; and C. drying the wet, retreated fabric or apparel at a temperature between about 130° F. and about 170° F. which enables the fluoroacrylate copolymer to reach a glass transition point that allows it to physically bridge with pre-existing fluoropolymer and provide a uniform coating. This temperature range also molecularly orients the fluoroacrylate copolymer on the retreated fabric or apparel.

A further embodiment of this invention is a spray restorative dispenser consisting essentially of:

I. a container having a wall, an orifice, and a volume contained within the wall;

II. a spray nozzle assembly having a spray nozzle and connected thereto, a siphon, wherein the siphon is inserted through the orifice and into the volume of the container;

III. a restorative liquid filling at least a portion of the volume of the container, wherein the restorative liquid consists of:
   (a) 0.1 to 10% by total weight of a fluoroacrylate copolymer emulsion,
   (b) 0.1 to 10% by total weight of a liquid coalescing agent, and
   (c) 80 to 99.8% by total weight of water; and optionally, IV. a propellant contained within the volume of the container or a manual pump assembly to facilitate evacuation of contents through the spray nozzle.

BRIEF DESCRIPTION OF THE DRAWINGS

The invention can be more fully understood from the following description thereof in connection with the accompanying drawings described as follows.

DETAILED DESCRIPTION OF THE INVENTION

Figure 1:
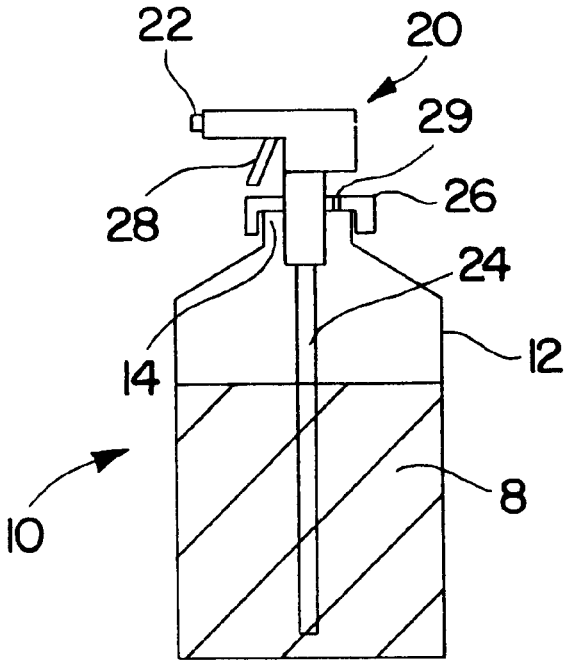
FIG. 1 is a view illustrating details of a spray dispenser of this invention having a pump nozzle assembly.

The present invention relates to an application method for restoring the water or stain repellency of outer wear, foot wear, apparel, clothing, shelters, or fabrics, including leather, that have already been pretreated with a water or stain repellent finish. This method involves washing the apparel item or fabric, rinsing it removing excess rinse water and then applying the restorative repellent treatment to the wet apparel item or fabric. The retreated apparel item or fabric is then dried and heated for a sufficient time to cause distribution of the new repellent material with residual amounts of the original repellent finish. The heating process also allows the resulting combination of repellents to better coat and penetrate all fibers on the surface of the apparel item or fabric, thereby enhancing the original repellency. This method allows the restorative treatment to be applied typically with no wetting agents or solvents by using the wash and rinse step to overwhelm any pre-existing repellency. Moreover, such restorative formulations have little or no flammability and are less toxic, less irritating to skin, and less odorous than mixtures containing solvents or wetting agents. Consequently such formulations used in the method of this invention have a reduced impact on the environment by elimination of solvent emissions and by generating less runoff of the restorative treatment at the time of application.

For the purposes of illustration this invention will be described hereinafter in reference to fabrics and apparel, but is not intended to be limited thereby. Consequently for the purposes of this invention, the terms "fabrics and apparel" as used hereinafter is intended to include outer wear, footwear, apparel, clothing, shelters, carpets, fabrics, leather, and the like. The method of this invention restores water or stain repellency to a pretreated fabric or apparel having an integral water impermeable, water-vapor permeable material as a part thereof, for example, expanded porous PTFE as described in 3,953,566. The pretreated fabric or apparel had been pretreated with a water or stain repellent finish at the factory and typically had lost a portion of the repellency through use and/or laundering. The method of this invention comprises the following steps in the order given. First the pretreated fabric or apparel is laundered and then rinsed to provide the wet, clean fabric or apparel. Laundering and rinsing are carried out in an automatic washing machine or by hand as directed by the manufacturer of the fabric or apparel and excess water is typically removed. However, the clean fabric or apparel must remain wet after laundering. Then the outer surface of the wet, clean fabric or apparel is sprayed with a restorative liquid which contains as its essential ingredients, a fluoroacrylate copolymer emulsion, a coalescing agent, such as dipropylene glycol monomethyl ether, ethylene glycol, acetone, dipropylene glycol, or the like and water. This step preferably is executed by hanging the fabric or apparel or by laying it on a flat surface and then spraying the outer surface with the restorative liquid using the spray restorative dispenser of the invention which will be described hereinafter. The resulting wet, retreated fabric or apparel is then dried at a temperature between about 130° F. and about 170° F., preferably with mechanical agitation, to provide the retreated fabric or apparel. Drying and heating may be conveniently accomplished in a conventional clothes dryer in which the retreated fabric or apparel is tumbled dry at medium heat for about 45 to about 60 minutes. The water and stain repellency of the retreated fabric or apparel may be further enhanced by ironing at a temperature between about 260° F. and about 300° F., e.g., at the low setting on a conventional iron. Since heating and mechanical agitation is crucial to the retreatment process of this invention, simple air drying followed by heating typically is not preferred, but can still effect restoration. For solid items such as footwear, the surface may be cleaned and rinsed conventionally, spray treated with the restorative and then heat dried on a rack in a conventional clothes dryer or with a stream of heated air such as with a conventional hair drier set at high heat or other such hot air heater.

A representative fluoroacrylate may contain over 50 percent by weight recurring units derived from $$CH_2{=}CR{-}COO{-}(CH_2)_n{-}(CF_2)_mF$$

where R is H or $CH_3$ and n and m are each integers between 1 and 15. Any remaining complementary recurring units being acrylate or methacrylate. It is well known that m is ordinarily a mixture of integers. It is seen that the molecular orientation referred to earlier, is, in the case of this fluoroacrylate, orientation of $CF_2$ side chains.

The restoration of water and stain repellency to the pretreated fabrics and apparel is efficiently carried out using the spray restorative dispenser of this invention which will now be described in reference to the figures. Throughout the following detailed description, similar reference characters refer to similar elements in all figures of the drawings.

Referring to FIG. 1, a pump-spray restorative dispenser has as its essential components a container 10, a pump-spray nozzle assembly 20, and a restorative liquid 8, filling at least a portion of the volume of container 10.

The container 10 has a wall 12, an orifice 14 typically in a neck of the container 10, and a volume contained within the wall 12 of the container 10 and defined thereby. The container 10 may have any convenient shape or size and may be formed from glass; metals such as steel, aluminum, and the like; or conventional plastics such as polyethylene, polypropylene, polyesters, and the like. Preferably, the container 10 is a bottle, a jug, or a can which can be hand held or at least easily transported by hand.

The pump-spray nozzle assembly 20 has a spray nozzle 22 and connected thereto through a pump assembly 28, a siphon 24. The siphon 24 is inserted through the orifice 14 and into the restorative liquid 8 in the container 10. The pump-spray nozzle assembly 20 typically has a cap or closure assembly 26, which surrounds the siphon 24 and encloses the orifice 14 of the container. Typically the cap 26 contains a vent 29 to allow air passage to replace pumped liquid sprayed out of the nozzle 22. The siphon 24 typically is a rigid tube sealed to the pump assembly 28 and having sufficient length to reach near the bottom of the container 10. Alternatively, the siphon 24 may be flexible hose with one end sealed to a hand held pump assembly and the other end immersed into the restorative liquid 8. The pump assembly 28 is a conventional finger-actuated pump which pumps restorative liquid 8 from the siphon 24 out through the nozzle 22. The spray nozzle may be adjustable.

The restorative liquid 8 which fills a portion of the volume of the container 10, consists of: about 0.1 to about 10%, preferably 0.1–5%, by weight of a fluoroacrylate copolymer emulsion, about 0.1 to about 10%, preferably 0.1–5%, by weight of dipropylene glycol monomethyl ether, and about 80 to about 99.8%, preferably 90–99.8%, by weight of water. Preferably, the restorative liquid 8 consists of 1.8% by weight of a fluoroacrylate copolymer emulsion, 0.7% by weight of dipropylene glycol monomethyl ether, and 97.5% by weight of water. The restorative liquid 8 preferably is a dilute emulsion of Repearl F-45 (a product of Mitsubishi International Corporation, New York, N.Y.). This formulation was used in Example 1.

Figure 2:
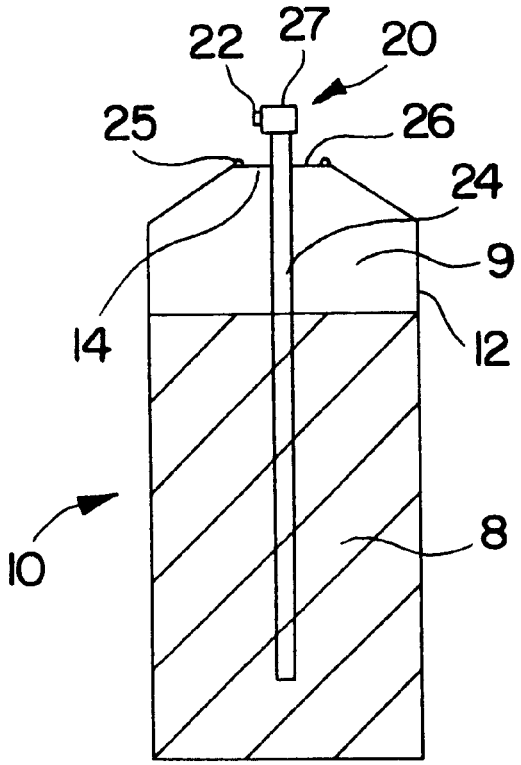
FIG. 2 is a view illustrating details of a spray dispenser of this invention having an aerosol nozzle assembly.

Referring to FIG. 2, an aerosol-spray restorative dispenser has as its essential components a container 10, an aerosol-spray nozzle assembly 20 which seals the container 10, a restorative liquid 8 filing at least a portion of the volume of container 10, and a propellant 9 contained within the volume of the container 10. The restorative liquid 8 has already been described supra in reference to FIG. 1.

Typically, the propellant 9 is a pressurized or liquefied gas such as air, carbon dioxide, and the like, which is charged into the dispenser at manufacture. Preferably, the propellant is a non-flammable gas to obviate any fire hazard. Alternatively, the propellant may be a compressed gas such as air or carbon dioxide, which is charged into the sealed container 10 through a separate entry port (not shown) in the container 10. In this instance, the compressed gas may be produced from a hand pump, a compressor, a cylinder of compressed gas or the like.

The container 10 has been generally described hereinabove in reference to FIG. 1 and such description applies as well to the aerosol-spray restorative dispenser with the following exceptions. The walls 12 of the container 10 must be capable of withstanding high internal pressures induced by the propellant, and the orifice 14 must be enclosed and pressure sealed by the aerosol-spray nozzle assembly 20. Typically, the container 10 is a metal can which is soldered or welded to the closure member 26 of the spray nozzle assembly 20. Alternatively, the container 10 may have a wall composed of heavy gauge polymeric or composite material, and the like.

The aerosol-spray nozzle assembly 20 has a spray nozzle 22 and connected thereto through a valve assembly 27, a siphon 24. The siphon 24 is inserted through the orifice 14 and into the restorative liquid 8 in the container 10. The aerosol-spray nozzle assembly 20 has a cap or closure assembly 26, which surrounds the siphon 24 and is pressure sealed thereto. The closure member 26 likewise encloses the orifice 14 and is pressure sealed to the container 10. Typically, the closure member 26 is soldered or welded to a metal container 10 such as a can by solder or weld 25. Alternatively, a closure member such as a cap or plug, may be screwed onto or into a threaded neck of the container 10 to enclose and seal the orifice 14. The siphon 24 is a rigid tube sealed to the valve assembly 27 and having sufficient length to reach near the bottom of the container 10. Alternatively, the siphon 24 may be flexible hose with one end sealed to a hand held valve assembly and the other end immersed into the restorative liquid 8. The valve assembly 27 is a simple spring-loaded, open/shut valve which is normally in the shut position. When depressed, the valve is opened and allows a stream of pressurized liquid to escape through the spray nozzle 22. The spray nozzle may be adjustable so as to control the quantity and spray pattern of the pressured liquid onto the fabric surface.

The method of this invention will now be illustrated by the following examples but is not intended to be limited thereby.

EXAMPLE 1

A used jacket, which has a shell fabric of expanded porous PTFE membrane laminated to a polyester or nylon, and previously treated with a water and stain repellent, is washed in an automatic washer according to instructions on the garment care label. After washing, the wet clean jacket is hung on a plastic hanger with the outer fabric of the jacket being exposed. While the jacket is still wet the outer fabric is sprayed using the restorative liquid referred to earlier. The bottle of restorative is first shaken well and then the garment is evenly sprayed holding the bottle 6 to 12 inches from the outer fabric. The jacket is then placed in an automatic clothes dryer and tumble dried separately for 50 minutes on medium heat. In a majority of cases, the dried jacket now performs as if new. However, the jacket may additionally be ironed using low heat for improved performance. The retreated jacket exhibits water and stain repellency at least as good as that of the jacket when it was new.

Those skilled in the art having the benefit of the teachings of the present invention as hereinabove set forth, can effect numerous modifications thereto. These modifications are to be construed as being encompassed within the scope of the present invention as set forth in the appended claims.

What is claimed is:

1. A method for restoring water or stain repellency to a pretreated fabric or apparel having an integral water impermeable, water-vapor permeable membrane, wherein said pretreated fabric or apparel had been pretreated with a water or stain repellent finish; the method comprising:

A. laundering and rinsing the pretreated fabric or apparel to provide a wet, clean fabric or apparel;

B. spraying an outer surface of the wet, clean fabric or apparel with a restorative liquid consisting of:
(a) a fluoroacrylate copolymer emulsion,
(b) a liquid coalescing agent, and
(c) water, to provide a wet, retreated fabric or apparel; and C. drying the wet, retreated fabric or apparel at a temperature between about 130° F. and about 170° F. to provide retreated fabric or apparel.

2. The method of claim 1 wherein the wet, retreated fabric or apparel is dried with mechanical agitation.

3. The method of claim 1 wherein the retreated fabric or apparel is ironed after step C at a temperature between about 260° F. and about 300° F.

4. The method of claim 3 wherein the fabric is comprised of expanded polytetrafluoroethylene.

5. The method of claim 1 wherein the pretreated apparel is clothing.

6. The method of claim 1 wherein the pretreated apparel is footwear.

7. The method of claim 1 wherein the pretreated fabric is a component of a shelter or a container.

8. A method for restoring water or stain repellency to a pretreated fabric or apparel having an integral water permeable, water-vapor permeable membrane, wherein said pretreated fabric or apparel had been pretreated with a water or stain repellent finish; the method comprising:

A. laundering and rinsing the pretreated fabric or apparel to provide a wet, clean fabric or apparel;

B. spraying an outer surface of the wet, clean fabric or apparel with a restorative liquid consisting of:
(a) a fluoroacrylate copolymer emulsion,
(b) a liquid coalescing agent, and
(c) water, to provide a wet, retreated fabric or apparel; and C. drying the wet, retreated fabric or apparel at a temperature above the glass transition temperature of the fluoroacrylate copolymer to provide retreated fabric or apparel.

9. The method of claim 8 wherein the fabric is comprised of expanded polytetrafluoroethylene.

10. The method of claim 8 wherein the pretreated apparel is clothing.

11. The method of claim 8 wherein the pretreated apparel is footwear.

* * * * *